US005250104A

United States Patent [19]

Berger et al.

[11] Patent Number: 5,250,104

[45] Date of Patent: Oct. 5, 1993

[54] METHOD AND APPARATUS FOR CONTROLLING PHASE SPLITTING AT PIPE JUNCTIONS

[75] Inventors: Eric L. Berger, Bakersfield, Calif.; James R. Stoy, Missouri City, Tex.; Mark T. Rubel; James L. G. Schrodt, both of Houston, Tex.

[73] Assignee: Texco Inc., White Plains, N.Y.

[21] Appl. No.: 961,977

[22] Filed: Oct. 16, 1992

[51] Int. Cl.[5] ..... B01D 19/00

[52] U.S. Cl. ..... 95/254; 95/260; 96/204; 96/220

[58] Field of Search ..... 55/36, 41, 43, 48, 52, 55/164, 165, 199, 201, 206

[56] References Cited

U.S. PATENT DOCUMENTS

| | | | |
|---|---|---|---|
| 1,467,512 | 9/1923 | Starke | 55/199 |
| 1,550,156 | 8/1925 | Fogler | 55/52 X |
| 2,039,411 | 5/1936 | Hartley | 55/41 |
| 3,308,607 | 3/1967 | Mueller | 55/201 |
| 3,525,196 | 8/1970 | Brieskorn | 55/52 |
| 4,261,708 | 4/1981 | Gallagher | 55/52 X |
| 4,279,628 | 7/1981 | Wymer et al. | 55/48 X |
| 4,519,815 | 5/1985 | Buls et al. | 55/164 X |
| 4,760,742 | 8/1988 | Hatton | 55/36 X |
| 4,824,445 | 4/1989 | Minkkinen | 55/43 X |
| 5,009,680 | 4/1991 | Brekke | 55/43 X |

FOREIGN PATENT DOCUMENTS

| | | | |
|---|---|---|---|
| 0133549 | 2/1985 | European Pat. Off. | 55/36 |
| 0669102 | 11/1929 | France | 55/36 |
| 0589561 | 1/1978 | U.S.S.R. | 55/201 |
| 1274195 | 5/1972 | United Kingdom | 55/52 |

*Primary Examiner*—Robert Spitzer

*Attorney, Agent, or Firm*—James L. Bailey; Jack H. Park; Russell J. Egan

[57] ABSTRACT

Separation of wet steam into its liquid and vapor phases is facilitated prior to encountering a junction. The separated phases are recombined as the steam exits the respective arms of the junction.

8 Claims, 1 Drawing Sheet

METHOD AND APPARATUS FOR CONTROLLING PHASE SPLITTING AT PIPE JUNCTIONS

BACKGROUND OF THE INVENTION

1. The Yield of the Invention

The present invention relates to a method and apparatus for substantially eliminating unequal phase splitting of wet steam at piping junctions and, in particular, to a system which separates the liquid and vapor phases upstream of the junction and recombines them in each outlet leg downstream of the junction in proportion to the vapor mass rate flowing in each outlet leg.

2. The Prior Art

There is a need for a simple method and apparatus to control phase splitting which occurs at piping junctions in wet steam distribution systems, particularly at impacting T-junctions. Such an apparatus, if simplified, would be particularly useful in controlling steam quality and thereby the amount of heat which is available since more heat is transmitted by the vapor phase of the steam than by the liquid phase.

Generally, as pressurized wet steam flows through a piping system, there is a tendency for the steam to separate into its vapor and liquid phases. The separation occurs with the heavier and slower liquid phase becoming annular and adhering to the piping walls while the lighter and faster gaseous phase moves axially through the piping. This results in steam of unequal quality coming off, for example, exiting the arms of an impacting T-junction.

It is important, therefore, as a matter of economic practicality that a means be instituted in the steam pipeline to prevent unwanted phase separation and promote homogeneity of the steam, particularly where it comes into and out of piping junctions.

Phase splitting is a phenomena of two phase vapor (or gas) and liquid flow that occurs at all piping junctions such as impact T's, branch T's, Y's, crosses, manifolds, etc. In standard junctions the liquid and vapor phases do not diverge in equal mass proportions except in junctions with symmetrical flow, such as in impact T's where the vapor mass rates are equal in each junction outlet (a vapor extraction ratio of 0.5). This is important, for example, in steamflood distribution systems, used for enhanced oil recovery, where it is desirable to deliver nearly equal steam quality throughout the entire distribution system. Steam quality is a measure of the proportion of the total mass that is vapor. The vapor extraction ratio is defined below.

$$\text{Vapor Extraction Ratio is, } F_{g3} = \frac{M_{v3}}{M_{v3} + M_{v2}} = \frac{M_{v3}}{M_{v1}}$$

Where, $F_{g3}$ = Vapor Extraction Ratio $M_{v1}$ = Inlet mass rate of the vapor phase $M_{v2}$ = Outlet branch 2 mass rate of vapor phase $M_{v3}$ = Outlet branch 3 mass rate of vapor phase Numerous studies investigating phase splitting have been conducted and various devices to equalize or control phase splitting have been tried. However, only a few of these ideas have been implemented in the design of new steam distribution systems and none have become standard practice throughout the industry. Still fewer of these methods are commonly encountered as "fixes", to minimize or control phase splitting, in distribution systems which were built before phase splitting was widely understood. The method disclosed here meets the criteria required of a "fix" in that it requires no operator action, creates minimal pressure drop, and is both inexpensive and effective.

An example of where the present invention would be particularly useful is secondary recovery of hydrocarbons from marginal fields or heavy oil reserves that require a degree of stimulation to achieve satisfactory flow of crude petroleum. In such operations steam is sent through a patterned array of injection wells to heat the formation being treated and drive the hydrocarbons towards a production well. The steam quality will directly affect the formation heatup effect and thus the efficiency of the recovery operation. The vapor phase of the steam will have the most heat and therefore have the greatest effect on the formation. Thus it is desirable to have steam of uniform quality injected into all portions of the formation.

SUMMARY OF THE INVENTION

The present invention substantially eliminates unequal phase splitting at piping junctions and automatically compensates for changes in vapor extraction ratio. It also allows for control of phase splitting when unequal steam quality splits are desired and introduces very little additional pressure drop. The present invention provides means to facilitate separation of the liquid and vapor phases and then, by directing the liquid phase through a bypass around the piping junction, recombines the liquid phase with the vapor phase downstream of the piping junction in proportion to the vapor extraction ratio at the junction.

BRIEF DESCRIPTION OF THE DRAWINGS

The present invention will now be described, by way of example, with reference to the accompanying drawings in which.

DESCRIPTION OF A PREFERRED EMBODIMENT OF THE INVENTION

Figure 1:
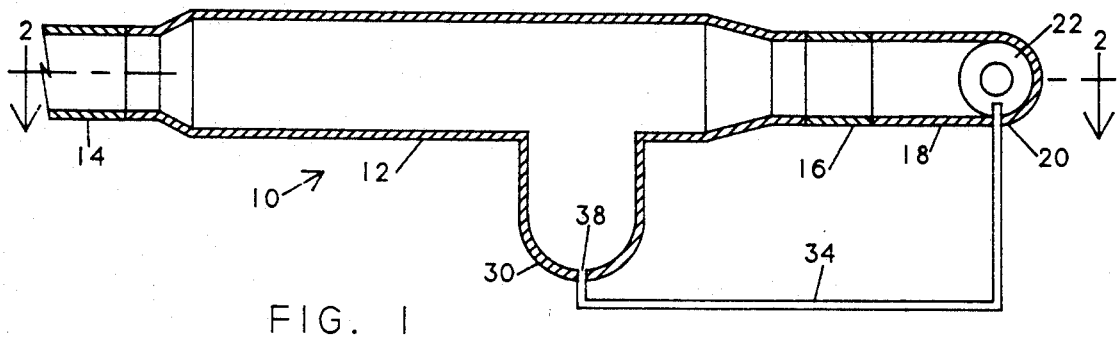
FIG. 1 is a vertical section, taken along line 1—1 of FIG. 2, through the device according to the present invention.
Figure 2:
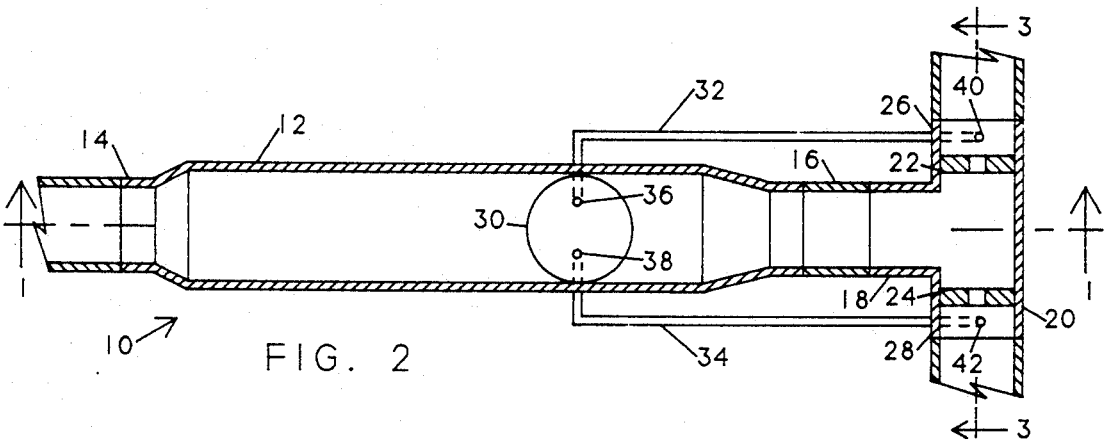
FIG. 2 is a horizontal section through the present invention taken along line 2—2 of FIG. 1.

The subject invention 10 has a phase separator 12, here shown as a large diameter section of pipe sufficient to allow for separation of the liquid and vapor phases, connected between a flow line 14 and an outlet pipe 16 connected to an inlet arm 18 of an impact T or other junction 20. The Figures depict an impact T junction, though other types of junction are possible, provided they are laterally symmetrical and offer no preferential path for the steam to follow (no "path of least resistance" as it were). The outlet pipe 16 of the separator 12 can be equipped with an insert (not shown) designed to minimize liquid carry over which could be expected in the event of annular or slug flow conditions. A flow constriction 22, 24, such as an orifice or venturi, is located at each outlet arm 26, 28, respectively, of the junction 20. The phase separator 12 has a sump 30 with small diameter pipes 32, 34, such as ½" tubing, connected between outlets 36 and 38 located near the bottom of the sump 30 to inlets 40 and 42 on each outlet arm 24, 26 from the junction 20 downstream of the respective flow constrictions 22, 24.

As the wet steam enters the large diameter of separator 12, its velocity is reduced allowing for separation of the vapor and liquid phases. The single vapor phase passes substantially axially through separator 12 to the outlet pipe 16, while the liquid phase, and possibly a portion of the vapor phase as well, drops into sump 30 and, via pipes 32, 34, effectively bypasses the junction 20 and reenters each outlet flow stream downstream of the piping junction 20.

The phase separator 12 serves to promote the complete separation of the liquid and vapor components of the wet steam by substantially reducing the velocity of the steam and allowing gravity to cause the actual separation of the two phases. The vapor phase moves axially through the large diameter section exiting through outlet pipe 16 to the inlet 18 of the horizontal junction 20. The liquid phase of the separated steam leaves the large diameter portion of separator 12 dropping vertically downward, under the influence of gravity, to sump 30 and subsequently flows through small diameter pipes 32, 34 to the outlet arms 26, 28 where the small diameter pipes 32, 34 pass through the junction walls immediately downstream of the flow constrictions 22, 24. The flow of high velocity steam vapor through the constrictions 22, 24 causes a low pressure region to occur immediately downstream of the constrictions (vena contracta) at the same point where the small diameter pipes enter the outlet arms. The existence of this low pressure region forces the liquid phase to be drawn forcibly into the high velocity vapor stream causing the liquid to form tiny droplets which become entrained in the flowing vapor. The liquid droplets are then carried with the vapor as it exits the horizontal impact T junction 20. Because the tiny droplets are finely dispersed in the vapor stream, the two phase steam behaves as a single phase fluid of homogeneous density. The resulting "fog" or "spray" flow steam streams, because the liquid and vapor phases are thoroughly mixed, leave the arms 26, 28 of T junction 20 at substantially equal steam qualities.

The present invention substantially eliminates the effect of phase splitting at impact T piping junctions with minimal pressure loss to the steam. The invention can also be applied to junctions with more than 2 outlets, provided that the multiple outlets are configured in such a way that there exists no "preferential path" for the steam to exit the junction. The invention performs this function by first separating the steam into its liquid and vapor components and conducting each component separately to a location where they are recombined in such a fashion to cause substantial mixing of the two components to occur. The remixed steam then behaves as a single phase vapor of homogeneous density at the point where the flow streams exit branches of the junction. The mixing of the two components is accomplished through the application of the same principle as that used to cause the atomization of liquids into a spray in a perfume atomizer, namely, aspiration.

Figure 3:
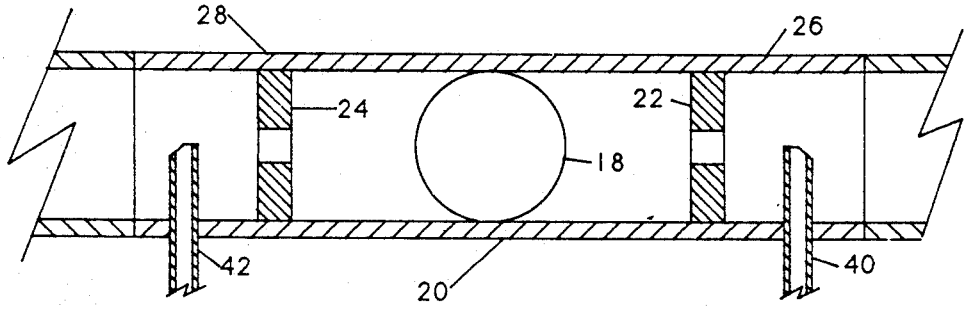
FIG. 3 is a detailed vertical section taken along line 3—3 of FIG. 2.

The shape and location of the ends of the small diameter pipes 32, 34 has been found to be of importance in optimizing the performance of the present invention. Experimentation has shown that the most effective location for the ends of the pipes is substantially aligned with the axis of the respective constriction 22, 24. Further, the performance of the device has been found to be best if the shape of the open ends of the pipes 32, 34 is as shown in FIG. 3.

The square root of the pressure drop created by the constriction is directly proportional to mass rate of vapor. The mass flow rate of liquid entering each outlet branch through the liquid bypass lines is also a function of the square root of the pressure drop created by the flow constrictions. Thus the flow rate of liquid entering each outlet branch is directly proportional to the vapor flow rate in each branch. The result is a system which is self compensating with respect to changes in the vapor extraction ratio.

Any means of separating the liquid and vapor phases upstream of the junction can be used. However large diameter piping, which reduces the velocity sufficiently to achieve stratified flow, can be used effectively, at low cost, without the requirements of a coded pressure vessel. Once separated the liquid phase is directed through relatively small diameter junction bypass piping to each junction outlet downstream of the outlet flow constriction.

The vapor phase flows predominately axially through the piping junction. The present invention is not limited to impact or branch T junctions but could also be used with a manifold having any number of outlets, as long as a junction bypass and a flow constriction is provided for each outlet. Since only single phase vapor passes through the junction, phase splitting cannot occur within the junction.

The distribution of the liquid phase, through each junction bypass to the respective junction outlet is induced by the pressure drop created as the vapor phase flows through the outlet constriction. Both the vapor flow rate through the junction outlet and the liquid flow rate through the junction bypass are directly proportional to the square root of the pressure drop. Thus the liquid and vapor flow rates are directly proportional to one another. As the vapor rate through an outlet decreases the liquid rate through the bypass decreases proportionally. As a result of this relationship the device compensates automatically when changes in vapor extraction ratio occur.

The sizing of the separator, the vapor flow constrictions, and the junction bypass lines define the range of flow conditions over which the device works effectively. If desired, the proportion of the liquid phase entering each branch can be controlled by either varying the diameter of the flow constriction, the diameter of the liquid bypass lines, or by adjusting valves (not shown) located in the bypass piping. The sizing of the vapor flow constrictions relative to the diameter of the junction bypass piping must allow the vapor phase to flow predominately through the junction while permitting all of the liquid to flow through the junction bypass. Undersizing the bypass piping would cause the separator to fill with liquid while oversizing could result in significant vapor liquid phase splitting in the sump. To overcome this limitation, a level control could be used t insure that only the liquid phase flows in the junction bypass piping and thus eliminating the potential for oversizing the bypass. However, excellent performance has been obtained without resorting to level control or means other than sizing to limit vapor flow in the junction bypass.

The present invention may be subject to many modifications and changes, which will be apparent to one skilled in the art, without departing from the spirit or essential characteristics thereof. The present embodiment is therefore to be considered in all respects as illustrative and not restrictive of the scope of the invention as defined by the appended claims.

We claim:

1. A method to assure equal steam quality in both outlet arms of a pipe junction, comprising the steps of:

providing a separator for separating the vapor and liquid phases upstream of a pipe junction with a vapor outlet of said separator connected to an inlet of the pipe junction and at least one conduit connecting a liquid outlet of said separator to each respective outlet arm of said pipe junction;

providing flow constriction means in each outlet arm of said pipe junction;

flowing wet steam into said separator wherein the vapor phase will travel substantially through to the pipe junction and the liquid phase will separate and fall under gravity into the bottom of said separator where it will flow through the liquid outlet and said at least one conduit to a point on each outlet arm of said pipe junction downstream of the flow constrictions due to the differential pressure created by the vapor phase as it flows past the flow constrictions such that the liquid flow rate in each outlet arm of said pipe junction resulting in nearly equal steam quality in each junction outlet.

2. An apparatus for assuring equal quality of wet steam in outlet arms of a pipe junction comprising:

separator means having an inlet connected to a steam flow pipe and a vapor outlet connected to an inlet of said pipe junction, said separator means facilitating separation of the wet steam into its liquid and vapor phases;

a liquid outlet in said separator means;

at least one by pass conduit connected between said liquid outlet and each outlet arm of said pipe junction; and flow constriction means in each outlet arm of said pipe junction whereby said liquid and vapor phases are effectively separated before encountering said pipe junction and then recombined upon exiting the respective outlet arms of the pipe junction.

3. The apparatus according to claim 2 wherein said constriction is an orifice.

4. The apparatus according to claim 2 wherein said constriction is a venturi.

5. The apparatus according to claim 2 wherein said separator means has a cross section of substantially larger diameter than the steam flow pipe.

6. The apparatus according to claim 2 wherein said separator means further comprises:

means to prevent liquid carryover out of the vapor outlet of said separator means.

7. The apparatus according to claim 2 wherein each said at least one bypass conduits terminates substantially axially of the respective constrictions.

8. The apparatus according to claim 2 wherein each said at least one bypass conduits in said outlet arms is profiled to enhance aspiration of the liquid phase passing therethrough.

* * * * *